US008217575B2

(12) United States Patent
Jeong et al.

(10) Patent No.: US 8,217,575 B2
(45) Date of Patent: Jul. 10, 2012

(54) PLASMA DISPLAY PANEL

(75) Inventors: Soon-Dong Jeong, Yongin-si (KR); Jae-Huy Park, Yongin-si (KR); Kyoung-Sik Jeon, Yongin-si (KR); Sun-Sik Kong, Yongin-si (KR); Bon-Joo Koo, Yongin-si (KR); Jung-Min Kim, Yongin-si (KR); Young-Soo Seo, Yongin-si (KR); Hyoung-Bin Park, Yongin-si (KR); Yu-Il Jang, Yongin-si (KR); Sung-Mun Ryu, Yongin-si (KR); Chong-In Chung, Yongin-si (KR); Sang-Hyuck Ahn, Yongin-si (KR); Jung-Sup Kwak, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 0 days.

(21) Appl. No.: 12/902,076

(22) Filed: Oct. 11, 2010

(65) Prior Publication Data

US 2011/0084604 A1 Apr. 14, 2011

(30) Foreign Application Priority Data

Oct. 12, 2009 (KR) ..... 10-2009-0096858

(51) Int. Cl.
*H01J 17/49* (2012.01)

(52) U.S. Cl. ..... 313/587; 313/586

(58) Field of Classification Search ..... 313/582–587
See application file for complete search history.

(56) References Cited

U.S. PATENT DOCUMENTS 6,603,263 B1 8/2003 Hashimoto et al.
2001/0050534 A1 12/2001 Amemiya et al.
2004/0189199 A1 9/2004 Komaki et al.
2005/0073254 A1 4/2005 Masuda et al.
2005/0179384 A1 8/2005 Kwon et al.
2005/0218805 A1 10/2005 Kitagawa et al.
2005/0242696 A1 11/2005 Song (Continued)

FOREIGN PATENT DOCUMENTS

EP 1 788 607 A2 5/2007

(Continued)

OTHER PUBLICATIONS

KIPO Registration Determination Certificate dated Sep. 26, 2011, for Korean Patent application 10-2009-0104303, 6 pages.

(Continued)

*Primary Examiner* — Bumsuk Won
(74) *Attorney, Agent, or Firm* — Christie, Parker & Hale, LLP

(57) ABSTRACT

A plasma display panel (PDP) including: first and second opposing substrates; a discharge layer disposed between the substrates, having discharge cells; address electrodes disposed on the first substrate, extending in a first direction, across the discharge cells; and display electrodes disposed on the second substrate, extending across the discharge cells in a second direction. The discharge layer includes: a discharge enhancement layer disposed on the first substrate, having first spaces; and a barrier rib layer disposed on the discharge enhancement layer, having second spaces that are connected to the first spaces, so as to form the discharge cells. The discharge enhancement layer further includes a perimeter member disposed in a dummy area provided at the edges of an effective area of the PDP.

19 Claims, 11 Drawing Sheets

U.S. PATENT DOCUMENTS

| | | | | |
|---|---|---|---|---|
| 2005/0242726 | A1 | 11/2005 | Mizuta | |
| 2005/0264197 | A1 | 12/2005 | Yoshinari et al. | |
| 2006/0082303 | A1* | 4/2006 | Song | 313/582 |
| 2007/0120486 | A1 | 5/2007 | Jang et al. | |
| 2008/0079366 | A1 | 4/2008 | Kim | |
| 2008/0174245 | A1 | 7/2008 | Soh et al. | |
| 2008/0211407 | A1* | 9/2008 | Song | 313/582 |
| 2009/0128035 | A1 | 5/2009 | Nam et al. | |
| 2009/0153049 | A1 | 6/2009 | Horiuchi et al. | |
| 2009/0184639 | A1 | 7/2009 | Kwon et al. | |

FOREIGN PATENT DOCUMENTS

| | | |
|---|---|---|
| JP | 2001-023515 | 1/2001 |
| KR | 10-1999-0075037 | 10/1999 |
| KR | 10-2001-0026890 | 4/2001 |
| KR | 10-2001-0039033 | 5/2001 |
| KR | 10-2004-0076969 | 9/2004 |
| KR | 10-2005-0088535 | 9/2005 |
| KR | 1020060110961 | 10/2006 |
| KR | 10-2007-0102249 | 10/2007 |
| KR | 10-2008-0069863 | 7/2008 |

OTHER PUBLICATIONS

European Search Report dated Jun. 16, 2010, for European Patent application 09251729.1, 7 pages.

European Office action dated May 13, 2011, for European Patent application 09251729.1, 5 pages.

U.S. Office action dated Jun. 22, 2011, for cross reference U.S. Appl. No. 12/870,771, 13 pages.

U.S. Office action dated Nov. 18, 2011, for cross reference U.S. Appl. No. 12/870,771, 13 pages.

U.S. Office action dated Mar. 30, 2011, for cross reference U.S. Appl. No. 12/589,750, 17 pages.

* cited by examiner

PLASMA DISPLAY PANEL

CROSS-REFERENCE TO RELATED APPLICATION

This application claims priority to Korean Patent Application No. 10-2009-0096858, filed in the Korean Intellectual Property Office on Oct. 12, 2009, the disclosure of which is incorporated herein, by reference.

BACKGROUND

1. Field

The described technology relates generally to a plasma display panel (PDP).

2. Description of the Related Art

A plasma display panel (PDP) electrically excites a discharge gas to generate a plasma discharge. The generated plasma discharge radiates vacuum ultra-violet (VUV) rays, and the VUV rays excite phosphors. As the phosphors are stabilized from an excited state, red (R), green (G), and blue (B) visible light is generated, to form an image.

For example, in an AC PDP, address electrodes are formed on a rear substrate, and a rear dielectric layer is formed to cover the address electrodes. Barrier ribs demarcate spaces on the rear dielectric layer, to form a matrix of discharge cells. Red (R), green (G), and blue (B) phosphors are formed on the rear dielectric layer and the barrier ribs. Display electrodes are formed on the discharge cells, such that they cross the address electrodes. A dielectric layer and an MgO protective layer are formed to cover the display electrodes, on the front substrate.

When the barrier ribs are formed to have a two-layered structure, the shape of the barrier wall pattern may be distorted and/or the barrier ribs may become detached from the front substrate, due to plastic shrinkage differences between materials of the respective layers. As a result, the image quality of the PDP may be degraded.

The above information disclosed in this Background section is only for enhancement of understanding of the background of the described technology, and therefore, it may contain information that does not constitute prior art.

SUMMARY

The described technology has been made in an effort to provide a plasma display panel (PDP) that can prevent an abnormal discharge and noise generated by the deformation of a barrier wall pattern or the delamination of barrier ribs.

An exemplary embodiment of the present teachings provides a plasma display panel (PDP) including; opposing first and second substrates; a discharge layer disposed between the first and second substrates, forming discharge cells; address electrodes extending in a first direction across the discharge cells; and display electrodes extending in a second direction across the discharge cells. The discharge cells each include a first space disposed at the second substrate side and a second space disposed at the first substrate side and connected with the first space. The discharge layer includes a discharge enhancement layer forming the first spaces and a barrier rib layer disposed on the discharge enhancement layer, forming the second spaces. The PDP includes an effective area to display images and a dummy area disposed around the effective area, which does not display an image. The discharge enhancement layer extends into the dummy area and covers the effective area. The barrier rib layer is formed on the discharge enhancement layer and extends from the effective area to an edge of the dummy area.

According to some aspects, the discharge enhancement layer includes a perimeter member disposed in the dummy area, which is not covered by the barrier rib layer, and may be spaced apart from the front substrate.

According to some aspects, the discharge enhancement layer may include first and second discharge enhancement members that extend in the first and second directions across each other, to thereby form the first spaces. The barrier rib layer may include first and second barrier ribs that extend across each other, disposed on the first and second discharge enhancement layer members, so as to form the second spaces.

According to some aspects, the width W12 of the second discharge enhancement members, taken in the first direction, may be larger than the width W22 of the second barrier ribs, taken in the first direction.

According to some aspects, the ratio W22/W12 may be more than or equal to 0.1 and less than or equal to 1.

According to some aspects, the width W11 of the first discharge enhancement members, taken in the second direction, may be equal to the width W21 of the first barrier ribs, taken in the second direction.

According to some aspects, the ratio of W21/W11 may be more than or equal to 0.1 and less than or equal to 1.

According to some aspects, the ratio T1/T, of the thickness T1 of the discharge enhancement layer to the overall thickness T of the discharge layer, may be more than or equal to 0.1 and less than 1.

According to some aspects, the ratio T2/T, of the thickness T2 of the barrier rib layer to the overall thickness T of the discharge layer, may be more than or equal to 0.1 and less than 1.

According to some aspects, a perimeter member of the first discharge enhancement layers, which extends in the second direction through the dummy area, may have a maximum line width Wmax that is larger than the width W11 of the discharge enhancement members.

According to some aspects, the width W12 may be larger than the width Wmax.

According to some aspects, the perimeter member includes a first member that extends in the first direction, and second members that extend in the second direction from the first member, to the effective area. The perimeter member may at least partially define dummy spaces.

According to some aspects, the dummy cells may be aligned with rows of the discharge cells and non-discharge cells, formed in the discharge layer.

According to some aspects, the V-shaped members may be separated by spaces corresponding to rows of the non-discharge cells.

According to some aspects, the discharge enhancement layer may include V-shaped perimeter members having faces that slope away from the barrier rib layer, toward the first substrate.

According to some aspects, the barrier rib layer may have different patterns at the effective area and at the dummy area.

According to some aspects, the ratio (V1/V2) of the volume V1 of the first spaces (S1) to the volumes V2 of the second spaces S2 may be greater at the effective area than at the dummy area.

According to some aspects, the discharge enhancement layer may include first and second discharge enhancement members extending in the first and second directions, respectively, to cross each other and configure the first spaces. The first discharge enhancement layer member may further include first extension portions extending in the first direction from the outermost second discharge enhancement member, into the dummy area.

According to some aspects, the barrier rib layer may include first and second barrier ribs extending across each other, on the first and second discharge enhancement layer members, respectively, to configure the second spaces. The first discharge enhancement members and the first barrier ribs may further include second extension portions extending in the first direction, from a second discharge enhancement layer member adjacent to the outermost second discharge enhancement member and the second barrier ribs, into the dummy area.

According to some aspects, the second extension portions may have a first length or a second length.

According to an exemplary embodiment of the present invention, the first spaces are formed by the discharge enhancement layer, the second spaces are formed by the barrier rib layer, on the discharge enhancement layer.

Additional aspects and/or advantages of the invention will be set forth in part in the description which follows and, in part, will be obvious from the description, or may be learned by practice of the present teachings.

BRIEF DESCRIPTION OF THE DRAWINGS

These and/or other aspects and advantages of the present teachings will become apparent and more readily appreciated from the following description of the exemplary embodiments, taken in conjunction with the accompanying drawings, of which.

DETAILED DESCRIPTION

Figure 1:
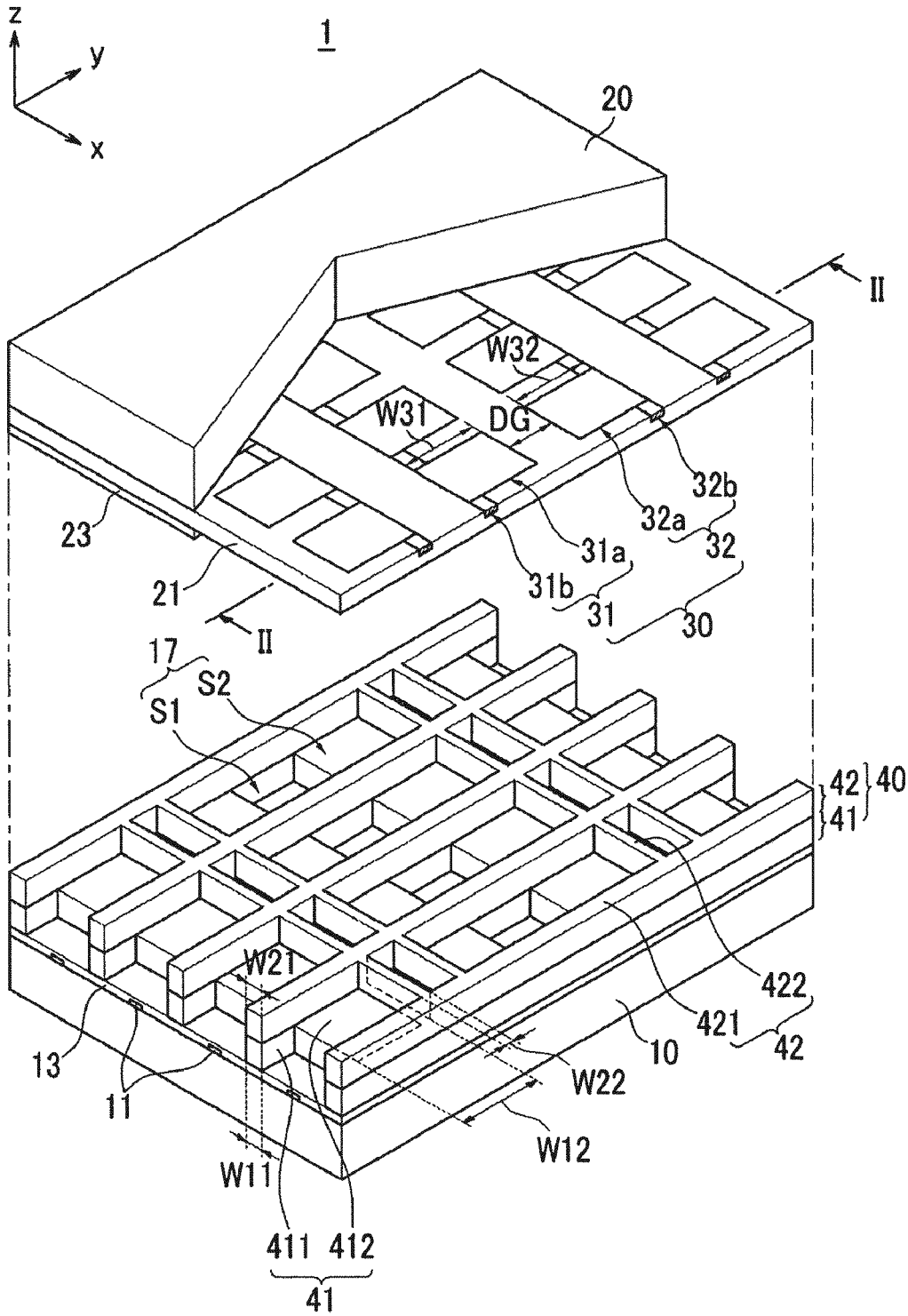
FIG. 1 is an exploded perspective view of a plasma display panel (PDP) according to a first exemplary embodiment of the present invention.

The present teachings will be described more fully hereinafter, with reference to the accompanying drawings, in which exemplary embodiments of the present teachings are shown. As those skilled in the art would realize, the described exemplary embodiments may be modified in various different ways, all without departing from the spirit or scope of the present teachings. The drawings and description are to be regarded as illustrative in nature and not restrictive. Like reference numerals designate like elements throughout the specification.

Herein, when a first element is referred to as being formed or disposed "on" a second element, the first element can be disposed directly on the second element, or one or more other elements may be disposed therebetween. When a first element is referred to as being formed or disposed "directly on" a second element, no other elements are disposed therebetween.

Figure 2:
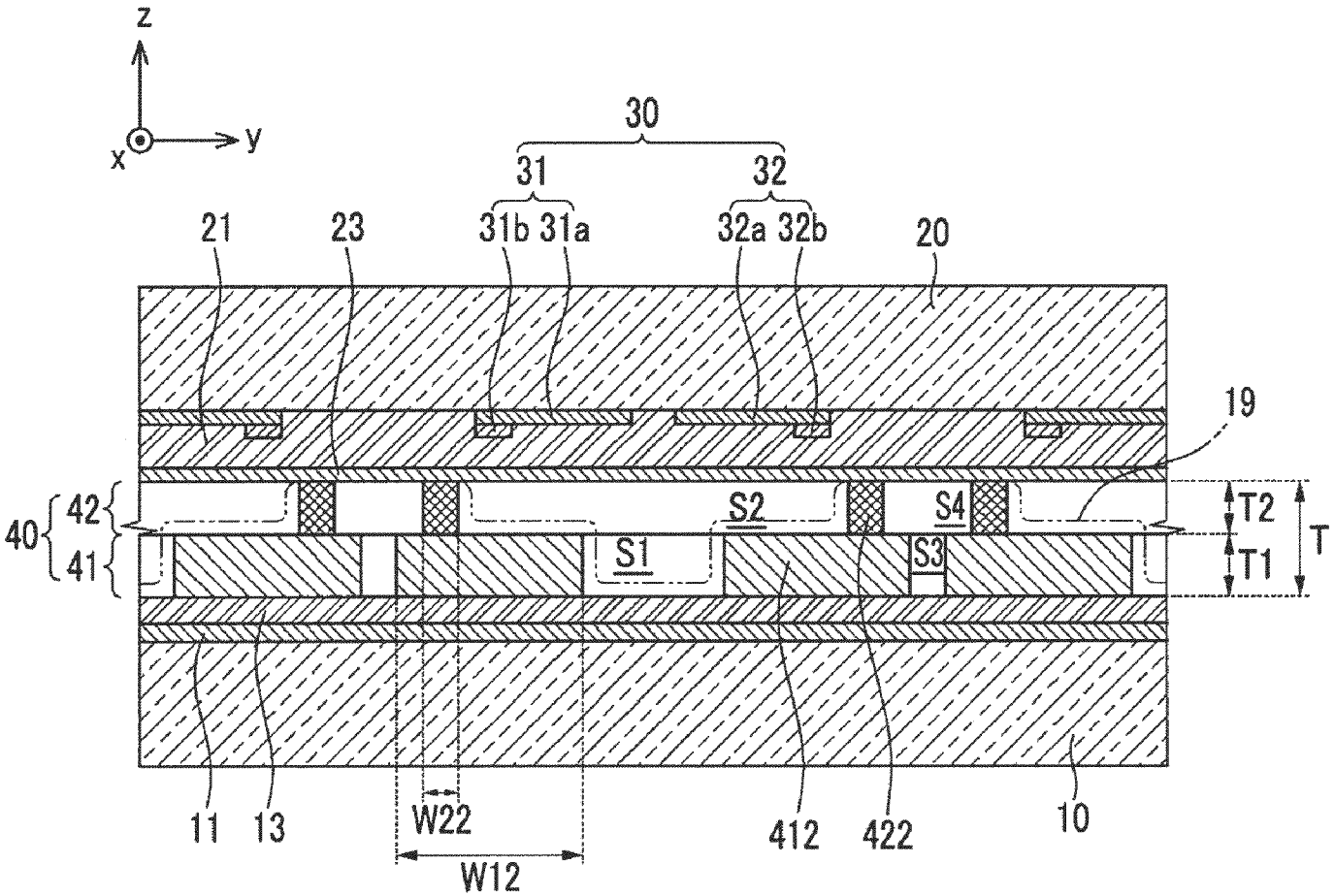
FIG. 2 is a sectional view taken along line II-II of FIG. 1.

FIG. 1 is an exploded perspective view of a plasma display panel (PDP) 1, according to a first exemplary embodiment of the present invention, and FIG. 2 is a sectional view taken along line II-II of FIG. 1. With reference to FIGS. 1 and 2, the PDP 1 includes a first substrate 10 (referred to as a "rear substrate" hereinafter), an opposing second substrate 20 (referred to as a "front substrate" hereinafter), and a discharge layer 40 disposed therebetween.

The discharge layer 40 forms a plurality of discharge cells 17. A phosphor layer 19 is disposed in the discharge cells 17. The discharge cells 17 are charged with a discharge gas (e.g., a gas mixture containing neon (Ne), xenon (Xe), etc.).

In order to clearly illustrate the structure of the discharge layer 40, the phosphor layer 19 is omitted in FIG. 1 and is illustrated as a line of alternating long and two short dashes in FIG. 2. The discharge gas generates ultraviolet rays, through a plasma discharge phenomenon. The ultraviolet rays excite the phosphor layer 19. The phosphor layer 19 emits red (R), green (G), and blue (B) light (i.e., visible light).

In order to generate a plasma discharge in the discharge cells 17, address electrodes 11 are disposed on the rear substrate 10 and display electrodes 30 are disposed on the front substrate 20. The display electrodes 30 include sustain electrodes 31 and scan electrodes 32.

The address electrodes 11 extend in a first direction (y-axis direction in the drawings), on an inner surface of the rear substrate 10. The address electrodes 11 extend along columns of the discharge cells 17 that extend in the y-axis direction. Also, the address electrodes 11 are disposed in the columns of the discharge cells 17, while maintaining a space corresponding to the discharge cells 17, along a second direction (x-axis direction in the drawings) crossing the y-axis direction. The address electrodes 11 extend parallel to each other (See FIG. 3).

A first dielectric layer 13 covers the inner surface of the rear substrate 10. The address electrodes 11 are formed on the inner surface of the rear substrate 10. The first dielectric layer 13 prevents damage to the address electrodes 11, due to the plasma discharge, and provides a place for the formation and accumulation of wall charges. That is, the first dielectric layer 13 protects the address electrodes 11, by preventing positive ions or electrons from directly colliding with the address electrodes 11, during discharging.

Because the address electrodes are disposed on the rear substrate 10, they do not interfere with transmission of visible light through the front substrate 20. Thus, the address electrodes 11 may be opaque electrodes, that is, made of a metal such as silver (Ag), having good electrical conductivity.

The sustain electrodes 31 and the scan electrodes 32 are formed on the inner surface of the front substrate 20, such that they correspond to the discharge cells 17. The sustain electrodes 31 and the scan electrodes 32 form a surface discharge structure within the discharge cells 17, to excite the discharge gas in each of the discharge cells 17.

Figure 3:
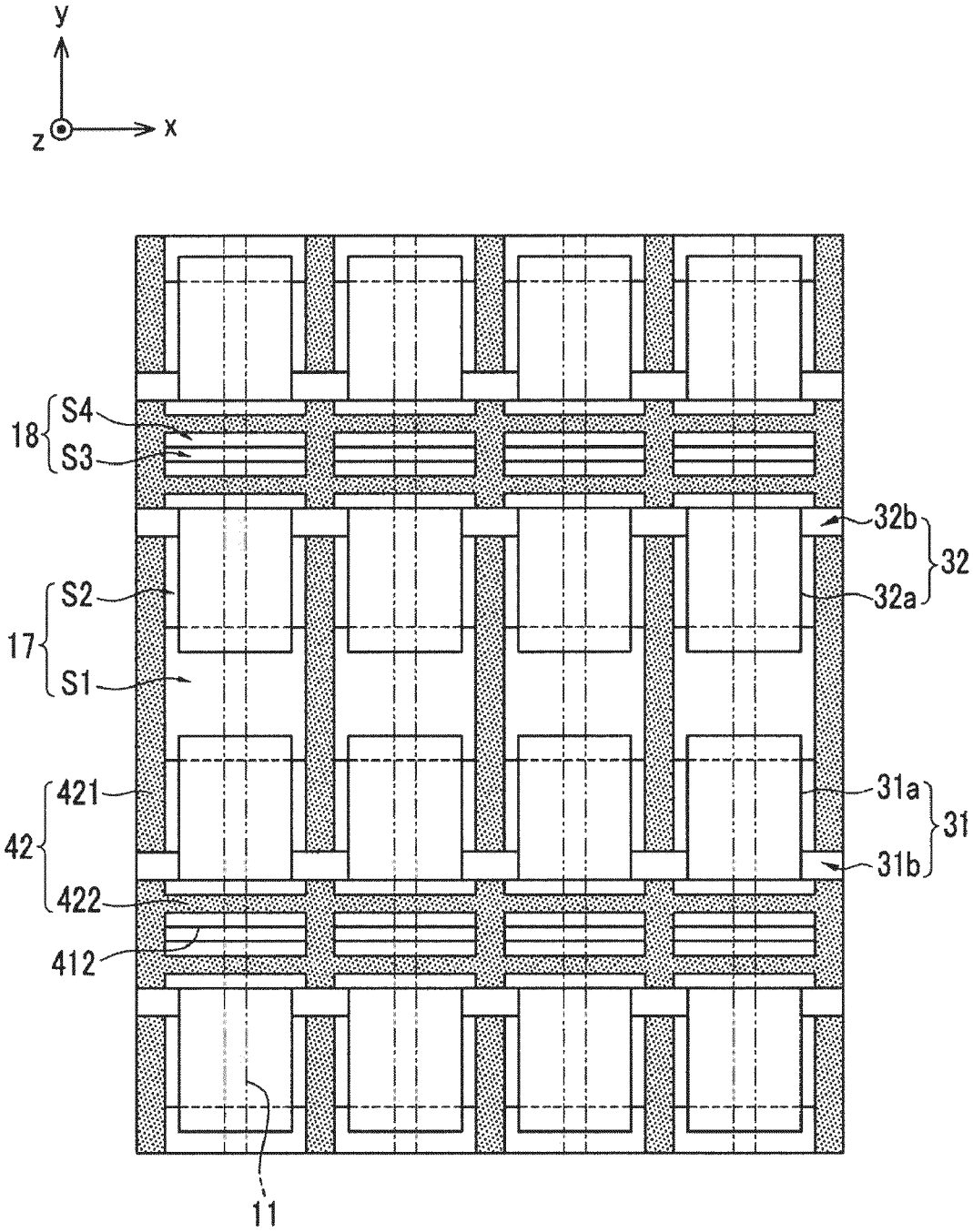
FIG. 3 is a plan view showing the disposition relationship between discharge cells and display electrodes configured by a discharge enhancement layer and a barrier wall layer.

FIG. 3 is a plan view showing the disposition relationship between the discharge cells 17 and the display electrodes 30.

With reference to FIG. 3, the sustain electrodes 31 and the scan electrodes 32 extend in the x-axis direction, across the address electrodes 11. The sustain electrodes 31 and the scan electrodes 32 extend below rows of the discharge cells 17, in the x-axis direction.

The sustain electrodes 31 and the scan electrodes 32 respectively include transparent electrodes 31*a* and 32*a* to produce the plasma discharge, and bus electrodes 31*b* and 32*b* to apply voltage signals to the transparent electrodes 31*a* and 32*a*, respectively. The transparent electrodes 31*a* and 31*b* have widths W31 and W32 at a central portion of each of the discharge cells 17, thereby forming a discharge gap (DG). The transparent electrodes 31*a* and 31*b* are made of, for example, indium tin oxide (ITO), in order to secure an aperture ratio of the discharge cells 17.

The bus electrodes 31*b* and 32*b* are disposed at opposing inner sides of each of the discharge cells 17, in the y-axis direction, extend in the x-axis direction, and are made of a metal material having good electrical conductivity, to apply voltage signals to the transparent electrodes 31*a* and 32*a*. Accordingly, when a voltage signal is applied to the bus electrodes 31*a* and 31*b*, the voltage signal is applied to the transparent electrodes 31*a* and 32*a* disposed within the discharge cells 17, via the bus electrodes 31*b* and 32*b*.

With reference to FIGS. 1 and 2, the PDP includes a second dielectric layer 21 formed on the front substrate 20 that covers the sustain electrodes 31 and the scan electrodes 32. The second dielectric layer 21 protects the sustain electrodes 31 and scan electrodes 32 against positive ions and electrons generated during discharging, and provides a place for formation and accumulation of wall charges. A protective layer 23 covers the second dielectric layer 21. For example, the protective layer 23 can be made of transparent MgO, allowing for the transmission of visible light and protecting the second dielectric layer 21 from positive ions or electrons generated during discharging. The protective layer 23 increases a secondary electron emission coefficient during discharging.

The phosphor layer 19 may be formed by coating a phosphor paste inside the discharge cells 17. The phosphor paste may be dried and fired after the coating. The phosphor layer 19 generates the different colors of light in each of the columns of the discharge cells 17 formed in the y-axis direction, such that adjacent columns generate different colors of light.

The phosphor layer 19 includes red (R), green (G), or blue (B) light emitting phosphors in respective ones the columns of the discharge cells 17, such that the phosphors are alternated in the x-axis direction. The red (R), green (G), and blue (B) phosphors are sequentially disposed in the x-axis direction.

In the PDP 1, an address discharge is applied to selected ones of the discharge cells 17, by the address electrodes 11. Then, a sustain discharge is produced between the sustain electrodes 31 and the scan electrodes 32 of the selected discharge cells 17, to display an image.

The discharge layer 40 includes a discharge enhancement layer 41 disposed on the first dielectric layer 13 and a barrier rib layer 42 disposed on the discharge enhancement layer 41. The discharge enhancement layer includes first and second discharge enhancement members 411, 412. The first discharge enhancement members 411 extend in parallel, in the y-axis direction. The second discharge enhancement members 412 extend in parallel, in the x-axis direction, across the first discharge enhancement members 411. Accordingly, first spaces S1 and third spaces S3 are at least partially defined by the discharge enhancement layer 41.

The barrier rib layer 42 includes first and second barrier ribs 421 and 422. The first barrier ribs 421 are disposed on the first discharge enhancement members 411, and extend in the y-axis direction. The second barrier ribs 422 are disposed on the second discharge enhancement members 412 and extend across the first barrier ribs 421, in the x-axis direction. Accordingly, spaces S2 and S4 are at least partially defined by the barrier rib layer 42. Corresponding ones of the spaces S1 and S2 form the discharge cells 17. In addition, corresponding ones of the spaces S3 and S4 form non-discharge cells 18, which are disposed between the discharge cells 17, in the y-axis direction. Two of the second barrier ribs 422 are formed between each of the discharge cells 17, in the y-axis direction. One of the second discharge enhancement members 412 is formed between each of the discharge cells 17, in the x-axis direction.

The dual layer structure of the discharge layer 40 prevents the discharge layer 40 from being distorted through the shrinkage or expansion thereof, and allows the front substrate 20 to be securely attached to the rear substrate 10. Accordingly, the occurrence of an abnormal discharge and the generation of noise are prevented.

Figure 4:
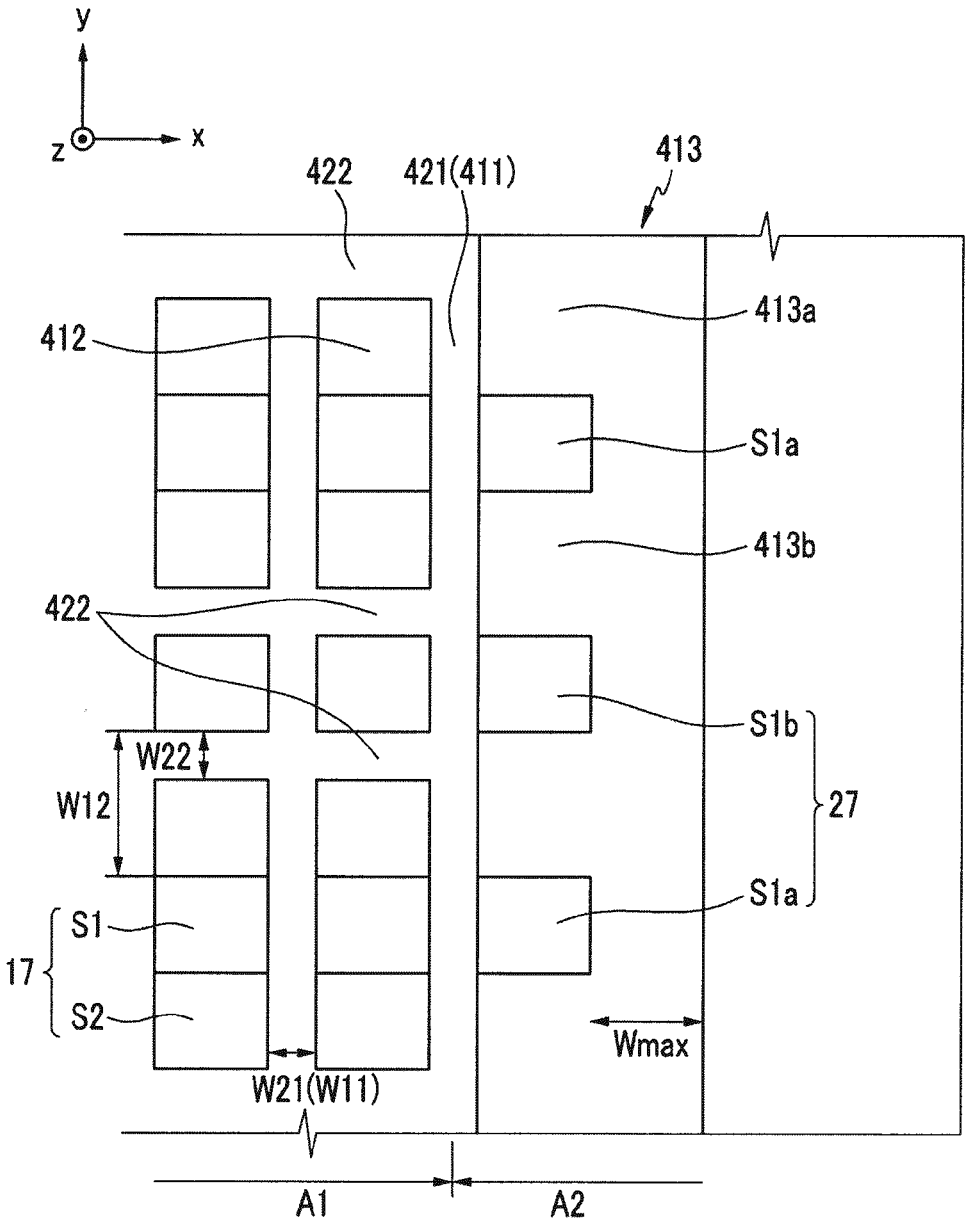
FIG. 4 is a top plan view of discharge cells configured by the discharge enhancement layer and the barrier wall layer at both ends of the display electrodes.
Figure 5:
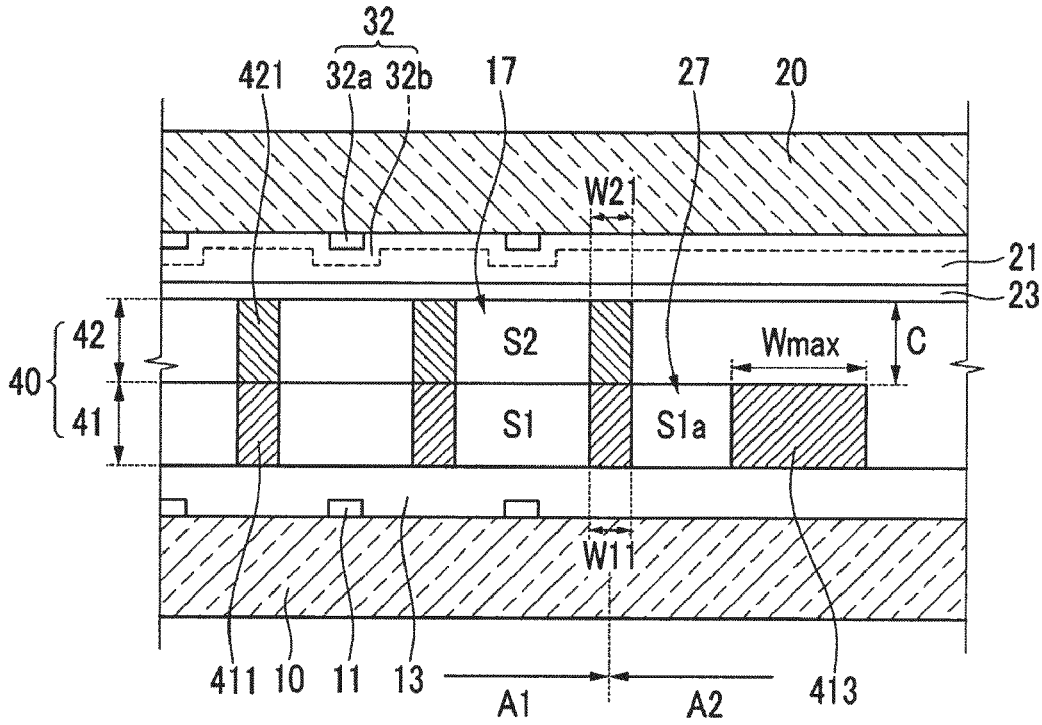
FIG. 5 is a sectional view taken along line V-V of FIG. 4.

FIG. 4 is a top plan view of discharge cells 17 of the PDP 1, and FIG. 5 is a sectional view taken along line V-V of FIG. 4. With reference to FIGS. 4 and 5, the PDP 1 includes an effective area A1 to display an image, and a dummy area A2 provided at the edges of the effective area A1, which does not display an image.

When viewed in the z-axis direction, the spaces S1 are shown to be smaller than the spaces S2, with the spaces S1 being disposed below and connected to corresponding ones of the spaces S2, to form the discharge cells 17.

The above described portions of the discharge enhancement layer 41 are formed in the effective area. However, the discharge enhancement layer 41 further includes perimeter members 413 disposed in the dummy area A2. The perimeter members 413 form first and second dummy spaces S1*a*, S1*b* that at least partially define dummy cells 27 (FIG. 5).

In comparison, the barrier rib layer 42 is formed in the effective area, but does not extend substantially past the edge of the effective area A1. In other words, the barrier rib layer 42 does not extend substantially into the dummy area A2. FIG. 5 illustrates the structure in which the barrier rib layer 42 is formed on the discharge enhancement layer 41.

Because the barrier rib layer 42 extends from the effective area A1 to only the edge of the dummy area A2, while the discharge enhancement layer 41 extends into the dummy area A2, a space (C) is formed between the discharge enhancement layer 41 and the front substrate 20, in the dummy area A2. Therefore, the front substrate 20 is tightly attached to the barrier rib layer 42, without separating from the barrier rib layer 42. All of the discharge enhancement layer 41 may be made of the same material, or the first and second discharge enhancement members 411, 412 may be made from a different material than the perimeter members 413. For example, the perimeter members 413 may be made of the same material as the barrier rib layer 42.

With reference to FIGS. 4 and 5, the perimeter member 413 increases the adhesion of the discharge enhancement layer 41 to the rear substrate 10, in the dummy area A2. Thus, plastic deformations of the discharge layer 40 can be reduced.

With reference to FIGS. 1, 2, 4, and 5, the width W12 of the second discharge enhancement members 412 may be larger than the width W22 of the second barrier ribs 422. The ratio W22/W12 may be more than or equal to 0.1 and less than or equal to 1. If the ratio W22/W12 is smaller than 0.1, the width W22 may be too small to form the second barrier ribs 422, and if W22/W12 is 1, the second discharge enhancement members and barrier ribs 412, 422 would have the same width (not shown).

The line width W11 of the first discharge enhancement members 411 may be equal to the width W21 of the first barrier ribs 421. Because the first discharge enhancement members 411 and the first barrier ribs 421 are formed to have the same line width, a high-definition PDP can be implemented having the dual layered barrier rib layer 40. A ratio W21/W11 may be more than or equal to 0.1 and less than or equal to 1. If the ratio W21/W11 is smaller than 0.1, the width W21 of the first barrier ribs 421 may be too small to form the barrier ribs. If the ratio W21/W11 is 1, the first discharge enhancement members 411 and the first barrier ribs 421 would have the same width (as shown in FIG. 5).

With reference to FIG. 2, the ratio T1/T, of the first thickness T1 of the discharge enhancement layer 41 to the overall thickness T of the barrier rib layer 40 in the z-axis direction, may be more than or equal to 0.1 an less than 1. If T1/T is smaller than 0.1, the thickness of the discharge enhancement layer 41 may be too small to obtain the effects of the dual-layered structure. If the T1/T is 1, the barrier ribs are formed only as the discharge enhancement layer 41 (illustrated at the dummy area A2). The ratio T2/T of the second thickness T2 of the barrier rib layer 42 to the thickness (T) of the barrier ribs 40 may be more than or equal to 0.1 and less than 1. If the thickness T2 is smaller than 0.1, the thickness of the barrier rib layer 42 may be too small to obtain the effect of the dual-layered structure. If the thickness T2 is 1, the barrier ribs are formed only as the barrier rib layer 42 (not shown).

With reference to FIGS. 4 and 5, the perimeter member 413 can include a first portion 413*a* that extends in the y-axis direction, and second portions 413*b* that extend in the x-axis direction, from the first portion 413*a* to the effective area A1. The width Wmax of the first portion 412*a*, between the dummy cells 27 and an outer edge of the first portion 413*a*, is larger than that of the width W11 of the first discharge enhancement members 411. In the dummy area A2, the width W12 of the second portions 413*a* is larger than the width Wmax of the first portions members 413*a*. Accordingly, the discharge enhancement layer 41 can be tightly attached to the rear substrate 10, in the dummy area A2. The perimeter member 413 maintains a strong adhesion to the rear substrate 10, along the y-axis, in the dummy area A2.

With reference to FIG. 4, the dummy cells 27 are disposed in a row extending in the y-axis direction and are at least partially defined by the perimeter member 413. The first dummy spaces S1*a* are aligned with rows of the discharge cells 17 that extend in the y-axis direction. In particular, the first dummy spaces S1*a* are aligned with the first spaces S1 of the discharge cells 17, in the y-axis direction. The second dummy spaces S1*b* are aligned with rows of the non-discharge cells 18, in the y-axis direction. That is, the second discharge enhancement members 412 and the second portions 413*b* increase the adhesion between the rear substrate 10 and the discharge enhancement layer 41. Because the discharge enhancement layer 41 has such strong adhesion with the rear substrate 10, and the barrier rib layer 42 is formed on the discharge enhancement layer 41, the barrier rib layer 42 can be strongly adhered to the rear substrate 10, via the discharge enhancement layer 41.

Figure 6:
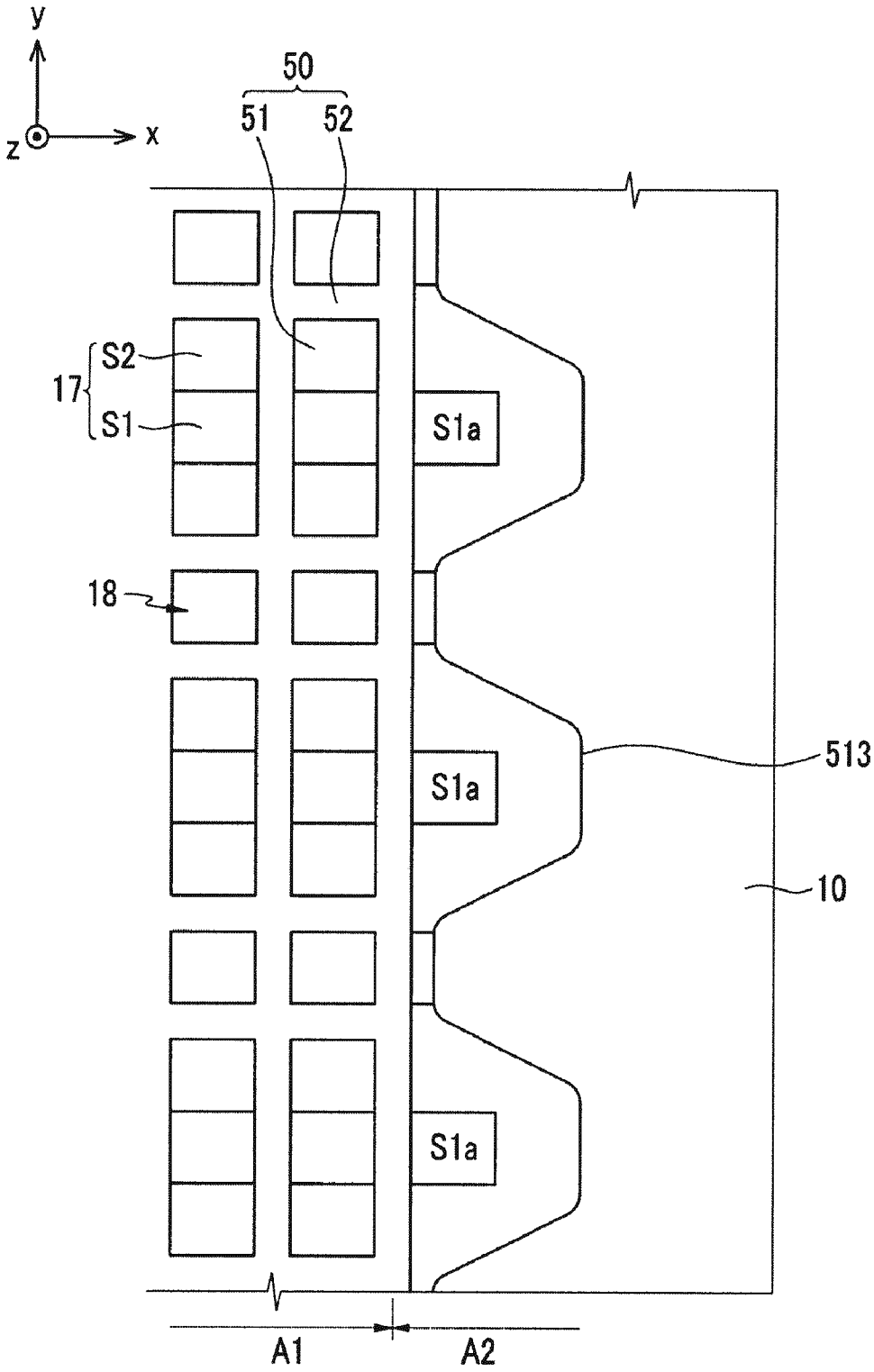
FIG. 6 is a top plan view of discharge cells configured by a discharge enhancement layer and a barrier wall layer at both ends of display electrodes of PDP according to a second exemplary embodiment of the present invention.

FIG. 6 is a top plan view of a discharge layer 50 including a discharge enhancement layer 51 and a barrier rib layer 52, at opposing ends of display electrodes of a PDP, according to a second exemplary embodiment of the present teachings. First dummy spaces S1*a* are formed in the discharge enhancement layer 51, and are disposed in rows extending in the y-axis direction, in the dummy area A2. The first dummy spaces S1*a* correspond to the first spaces S1 of the discharge enhancement layer 51, which are disposed, in the effective area A1. The second dummy spaces S1*b* are omitted in this exemplary embodiment.

The discharge enhancement layer 51 includes perimeter members 513. The perimeter members 513 may for a V-shape, around the first dummy spaces S1*a*. The perimeter members 513 are spaced apart in the y-axis direction, by spaces corresponding to rows of non-discharge cells 18 that extend in the x-axis direction. The perimeter members 513 may have faces that slope away from the barrier rib layer 52, toward a rear substrate 10 (along the z-axis direction).

The sloped faces of the perimeter members 513 allow for a reduction in the material used to form the same, without sacrificing adhesion between the discharge enhancement layer 51 and the rear substrate 10. Accordingly, in spite of differences in plastic shrinkage, between the discharge enhancement layer 51 and the barrier rib layer 52, deformation of the pattern of the discharge layer 50 and the separation of the discharge layer 50 can be prevented. Also, the occurrence of an abnormal discharge can be prevented, and noise can be reduced.

Figure 7A:
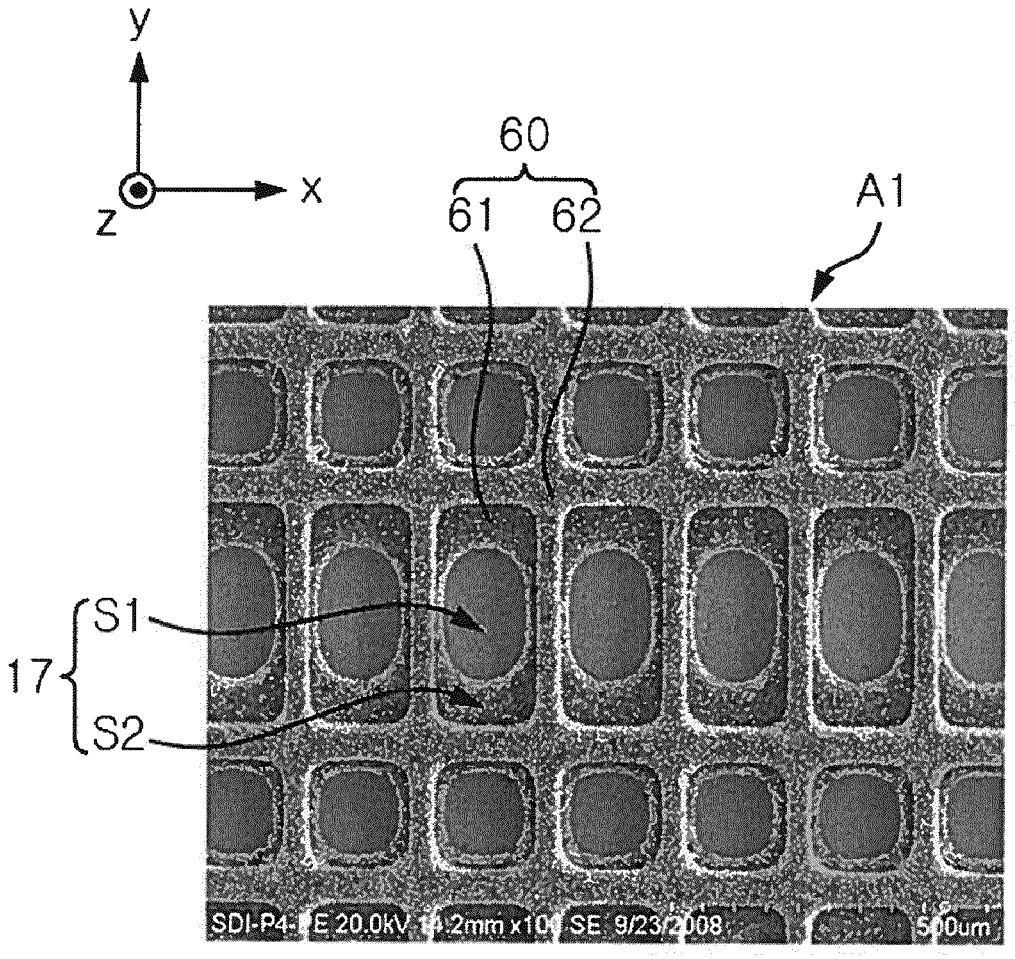
FIGS. 7A and 7B are top plan views of discharge cells configured by a discharge enhancement layer and a barrier rib layer at an effective area and at a dummy area of a PDP according to a third exemplary embodiment of the present invention.
Figure 7B:
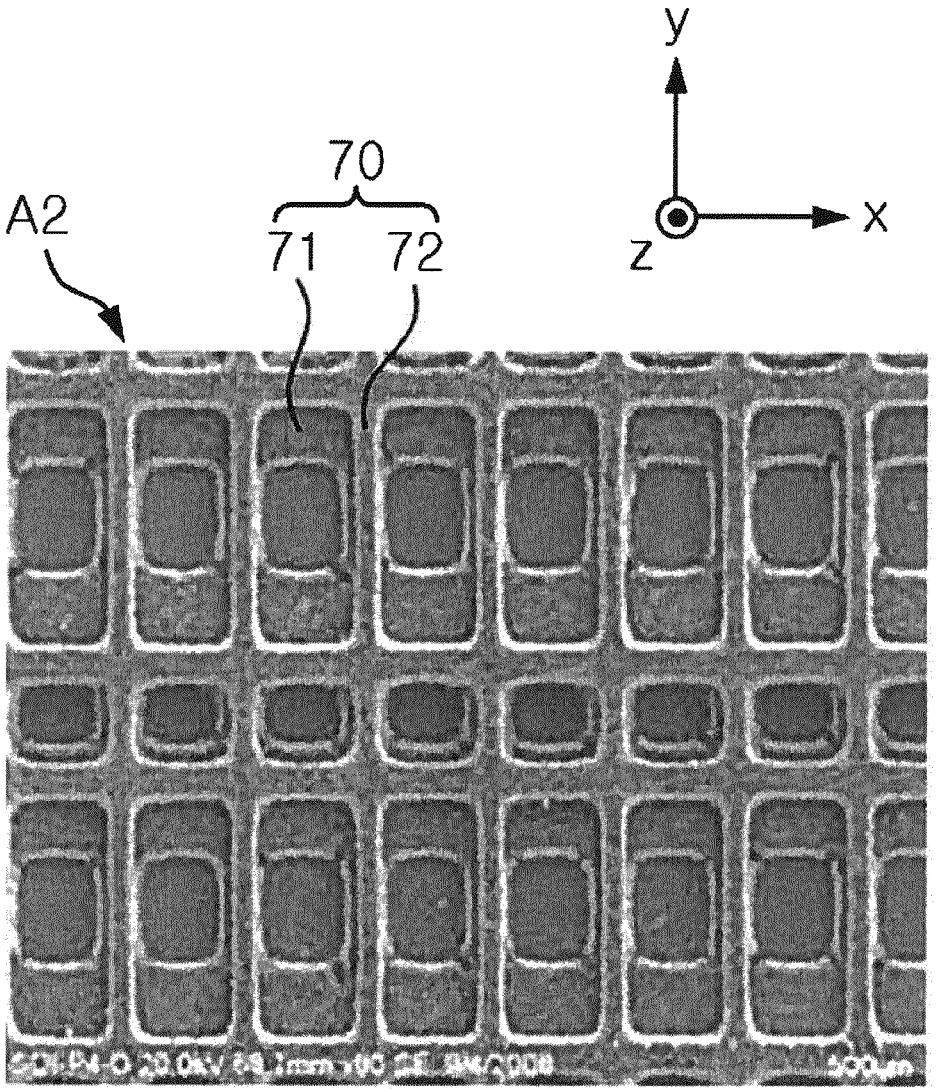

FIGS. 7A and 7B are top plan views of discharge layers 60 and 70 cells formed in a discharge enhancement layer and a barrier rib layer, in an effective area and a dummy area of a PDP, according to exemplary embodiments of the present teachings.

In the first exemplary embodiment, the discharge layer 40 has the same pattern in the effective area A1 and the dummy area A2, with respect to the first and second spaces S1 and S2. In comparison, in the third exemplary embodiment of FIGS. 7A and 7B, discharge layers and first and second spaces are formed to have different patterns in the effective area A1 and the dummy area A2. That is, the discharge layer 60 is formed such that the size of the discharge cells 17 is increased in the effective area A1, and that the adhesion between the discharge layer 70 and the rear substrate 10 is increased, in the dummy area A2.

For example, in a discharge cell 17, a discharge enhancement layer 61 forms first spaces S1, and a barrier rib layer 62 forms second spaces S2. The ratio S1/S2 of the first space S1 to the second space 52 is larger in the effective area A1 than in the dummy area A2. That is, if the discharge enhancement layer 61 and the barrier rib layer 62 are formed to have the same size in the z-axis direction, and the second spaces S2 are formed to have the same size at the effective area A1 and the dummy area A2. Increasing the size of the first spaces S1 increases the size of discharge cells 17, thereby improving discharge efficiency. In addition, the size of a discharge enhancement layer 71 in the dummy area A2 can be increased, as compared with that of the effective area A1, to enhance the adhesion between the discharge enhancement layer 71 and the rear substrate 10, and the adhesion between the discharge enhancement layer 71 a barrier rib layer 72. Thus, in spite of the difference of the plastic shrinkage between the discharge enhancement layers 61 and 71 and the barrier rib layers 62 and 72, deformation of the pattern of the barrier rib layers 60 and 70, and the occurrence of a separation phenomenon of the front substrate 20, can be prevented. Also, the occurrence of an abnormal discharge can be prevented, and noise can be reduced.

Figure 8:
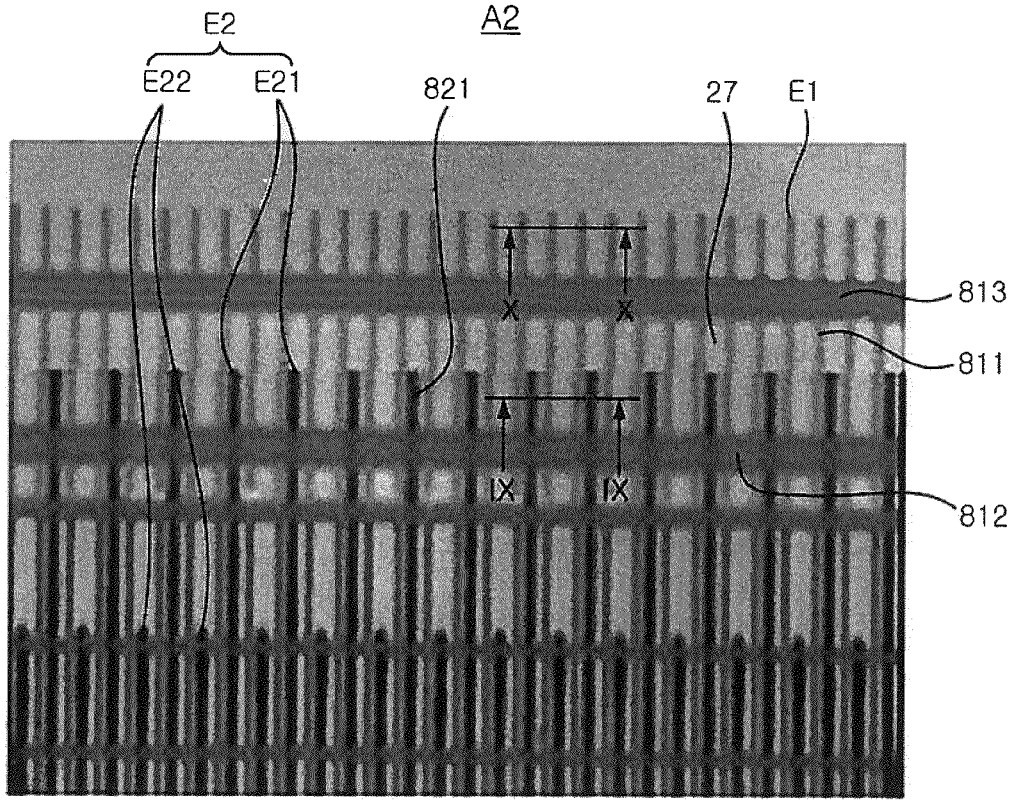
FIG. 8 is a top plan view of dummy cells configured by a discharge enhancement layer and a barrier rib layer at a dummy area of a PDP according to a fourth exemplary embodiment of the present invention.
Figure 9:
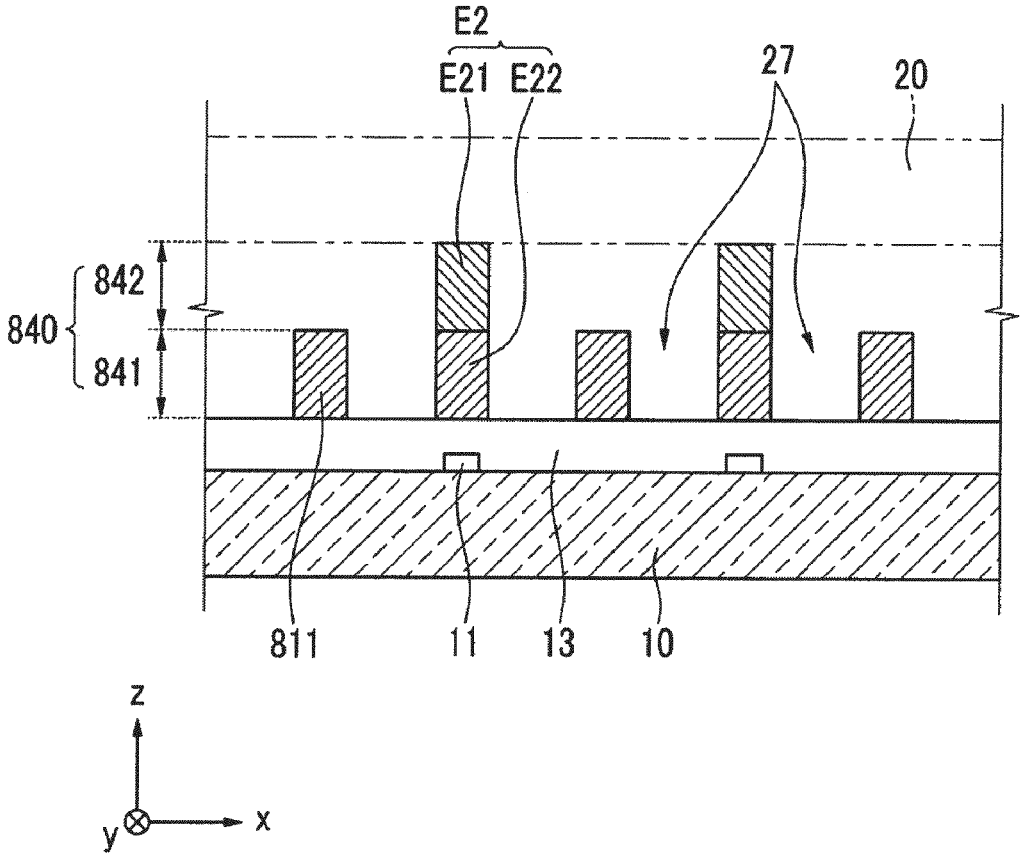
FIG. 9 is a sectional view taken along line IX-IX of FIG. 8.
Figure 10:
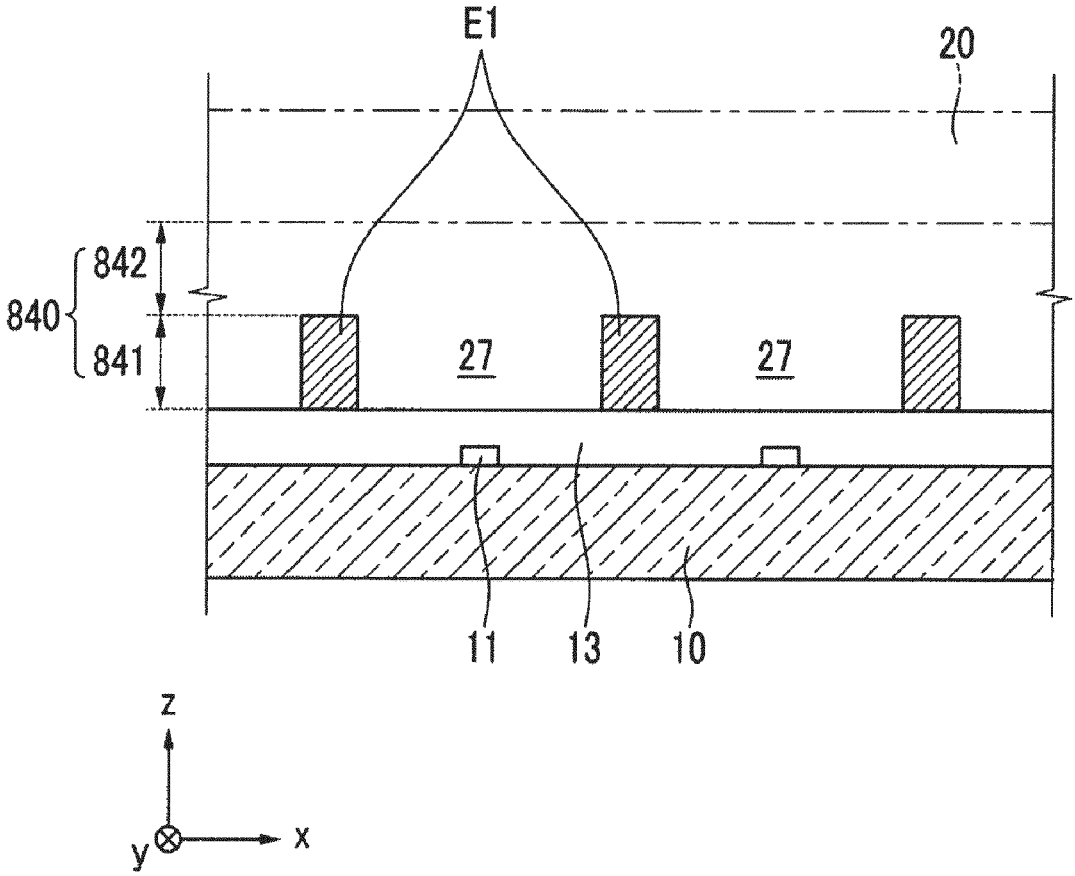
FIG. 10 is a sectional view taken along line X-X of FIG. 8.

FIG. 8 is a top plan view of dummy cells configured by a discharge enhancement layer and a barrier rib layer, in a dummy area of a PDP, according to a fourth exemplary embodiment of the present teachings, FIG. 9 is a sectional view taken along line IX-IX of FIG. 8, and FIG. 10 is a sectional view taken along line X-X of FIG. 8.

With reference to FIGS. 8 to 10, the PDP includes a discharge layer 840, including a discharge enhancement layer 841 and a barrier rib layer 842. The discharge enhancement layer 841 includes first discharge enhancement members 811 and a perimeter member 813. The perimeter member 813 includes first extensions E1 extending in the y-axis direction. The discharge enhancement layer 41 can have reinforced adhesive power with the rear substrate 10, by virtue of the first extensions E1, even at an outer side of dummy cells 27. In the present exemplary embodiment, the first extensions E1 are made of the same material as the rest of the discharge enhancement layer 41 and are formed on a rear substrate 10. However, the first extensions E1 may be made of a material used to form the barrier rib layer 842, i.e., a different material than the material of the first discharge enhancement members 811.

With reference to FIGS. 8 and 9, the first discharge enhancement layer 841 and the barrier rib layer 842 further include second extension portions E2 extending in the y-axis direction, into the dummy area A2. The discharge enhancement layer 841 and the barrier rib layer 842 can have stronger adhesive power with the rear substrate 10, by virtue of the second extension portions E2 and the first extensions E1.

The second extension portions E2 include first portions E21 and second portions E22 that have different lengths. The first portions E21 may extend past an outermost barrier rib. The second portions E22 may extend to a barrier rib adjacent to the outermost barrier rib. The discharge enhancement layer 841 and the barrier rib layer 842 can enhance the adhesion power to the rear substrate 10, by virtue of the second portions E2.

While this disclosure has been described in connection with what is presently considered to be practical exemplary embodiments, it is to be understood that the present teachings are not limited to the disclosed exemplary embodiments, but, on the contrary, are intended to cover various modifications and equivalent arrangements included within the spirit and scope of the appended claims.

What is claimed is:

1. A plasma display panel having an effective area to display an image and a dummy area disposed around the effective area, the plasma display panel comprising:
- opposing first and second substrates;
- address electrodes extending in a first direction, disposed on the first substrate;
- display electrodes extending in a second direction crossing the first direction, disposed on the second substrate; and
- a discharge layer disposed between the first and second substrates, having discharge spaces and non-discharge spaces disposed between the discharge spaces, in the first direction, the discharge layer comprising:
  - a discharge enhancement layer disposed on the first substrate, having first spaces formed therein; and
  - a barrier rib layer disposed on the discharge enhancement layer, having second spaces formed therein that are connected to corresponding ones of the first spaces, such that the first and second spaces form discharge cells,
- wherein the barrier rib layer and the discharge enhancement layer are disposed in the effective area,
- wherein the discharge enhancement layer comprises a perimeter member disposed in the dummy area and extending from the effective area, and
- wherein the perimeter member is not covered by the barrier rib layer and is spaced apart from the second substrate.

2. The panel of claim 1, wherein:
- the discharge enhancement layer comprises:
  - first discharge enhancement members extending in the first direction; and
  - second discharge enhancement members extending in the second direction, across the first discharge enhancement members, so as to form the first spaces; and
- the barrier rib layer comprises:
  - first barrier ribs disposed on the first discharge enhancement members; and
  - second barrier ribs disposed on the second discharge members, so as to form the second spaces.

3. The panel of claim 2, wherein the width W12 of the second discharge enhancement members is larger than the width W22 of the second barrier ribs.

4. The panel of claim 2, wherein a ratio W22/W12 is more than or equal to 0.1 and less than or equal to 1.

5. The panel of claim 2, wherein the width W11 of the first discharge enhancement members is equal to the width W21 of the first barrier ribs.

6. The panel of claim 5, wherein,
- the perimeter member forms dummy spaces, and
- a width Wmax of the perimeter member, between the dummy spaces and the outermost edge of the perimeter member, is larger than the width W11.

7. The panel of claim 6, wherein the width W12 is larger than the width Wmax.

8. The panel of claim 6, wherein each of the dummy spaces is aligned with a row of the discharge spaces extending in the second direction.

9. The panel of claim 8, wherein the perimeter member comprises V-shaped members disposed around each of the dummy spaces, having a surface that faces the second substrate and is sloped away from the effective area.

10. The panel of claim 2, wherein a ratio of W21/W11 is more than or equal to 0.1 and less than or equal to 1.

11. The panel of claim 2, wherein a ratio (T1/T) of the thickness T1 of the discharge enhancement layer to the overall thickness (T) of the discharge layer is more than or equal to 0.1 and less than 1.

12. The panel of claim 2, wherein a ratio (T2/T) of the thickness T2 of the barrier rib layer to the overall thickness (T) of the discharge layer is more than or equal to 0.1 and less than 1.

13. The panel of claim 2, wherein the perimeter member comprises:
- a first member that extends in the first direction; and
- second members that extend in the second direction between the dummy spaces, from the first member to the effective area.

14. The panel of claim 13, wherein the dummy spaces are each aligned in the first direction with rows of the discharge spaces extending in the second direction, or rows of the non-discharge spaces extending in the second direction.

15. The panel of claim 1, wherein the discharge layers are formed to have different patterns at the effective area and at the dummy area.

16. The panel of claim 1, wherein:
- the discharge enhancement layer comprises first and second discharge enhancement members extending across one another, in the first and second directions, respectively, to form the first spaces; and
- the perimeter member comprises first extension portions extending in the first direction, away from the effective area.

17. The panel of claim 16, wherein:

the barrier rib layer comprises first and second barrier ribs extending to cross one another, disposed on the first and second discharge enhancement members respectively, to form the second spaces; and the first discharge enhancement members and the first barrier ribs further comprise second extension portions extending in the first direction from another second discharge enhancement member and another second barrier rib, into the dummy area.

18. A plasma display panel having an effective area to display an image and a dummy area disposed around the effective area, the plasma display panel comprising:

opposing first and second substrates;

address electrodes extending in a first direction, disposed on the first substrate;

display electrodes extending in a second direction crossing the first direction, disposed on the second substrate; and a discharge layer disposed between the first and second substrates, having discharge spaces and non-discharge spaces disposed between the discharge spaces, in the first direction, the discharge layer comprising:

a discharge enhancement layer disposed on the first substrate, having first spaces formed therein; and a barrier rib layer disposed on the discharge enhancement layer, having second spaces formed therein that are connected to corresponding ones of the first spaces, such that the first and second spaces form discharge cells, wherein the barrier rib layer and the discharge enhancement layer are disposed in the effective area, wherein the discharge enhancement layer comprises a perimeter member disposed in the dummy area and extending from the effective area, wherein the discharge layers are formed to have different patterns at the effective area and at the dummy area, and wherein a ratio of the volume V1 of the first space to the volume V2 of the second space (V1/V2) is greater at the effective area than at the dummy area.

19. A plasma display panel having an effective area to display an image and a dummy area disposed around the effective area, the plasma display panel comprising:

opposing first and second substrates;

address electrodes extending in a first direction, disposed on the first substrate;

display electrodes extending in a second direction crossing the first direction, disposed on the second substrate; and a discharge layer disposed between the first and second substrates, having discharge spaces and non-discharge spaces disposed between the discharge spaces, in the first direction, the discharge layer comprising:

a discharge enhancement layer disposed on the first substrate, having first spaces formed therein; and a barrier rib layer disposed on the discharge enhancement layer, having second spaces formed therein that are connected to corresponding ones of the first spaces, such that the first and second spaces form discharge cells, wherein the barrier rib layer and the discharge enhancement layer are disposed in the effective area, wherein the discharge enhancement layer comprises a perimeter member disposed in the dummy area and extending from the effective area, wherein the discharge enhancement layer further comprises first and second discharge enhancement members extending across one another, in the first and second directions, respectively, to form the first spaces, wherein the perimeter member comprises first extension portions extending in the first direction, away from the effective area, wherein the barrier rib layer comprises first and second barrier ribs extending to cross one another, disposed on the first and second discharge enhancement members respectively, to form the second spaces, wherein the first discharge enhancement members and the first barrier ribs further comprise second extension portions extending in the first direction from another second discharge enhancement member and another second barrier rib, into the dummy area, and wherein a first group of the second extension portions has a first length and a second group of the second extension portions has a second length that is less than the first length, with the second extension portions of the first and second groups being alternately disposed on the first substrate.

* * * * *